United States Patent [19]

Nieri

[11] Patent Number: 4,579,195

[45] Date of Patent: Apr. 1, 1986

[54] EXHAUST GAS SILENCER

[76] Inventor: Giuseppe Nieri, 30 Piazzo Gramsci, 57023 Cecina (Livorno), Italy

[21] Appl. No.: 610,528

[22] Filed: May 15, 1984

[30] Foreign Application Priority Data

Jun. 2, 1983 [IT] Italy ..... 40053 A/83

[51] Int. Cl.[4] ..... F01N 1/12

[52] U.S. Cl. ..... 181/279; 181/272; 181/273; 181/280; 181/282

[58] Field of Search ..... 181/274, 279, 280, 282, 181/206, 268, 273

[56] References Cited

U.S. PATENT DOCUMENTS

| | | | |
|---|---|---|---|
| 794,926 | 7/1905 | Crawford | 181/279 |
| 943,233 | 12/1909 | Boyle | 181/279 |
| 1,638,780 | 8/1927 | Neil | 181/280 |
| 1,812,413 | 6/1931 | Reynolds | 181/279 |
| 2,057,304 | 10/1936 | Saint-Jacques | 181/274 |
| 2,139,736 | 12/1938 | Durham | 181/274 |
| 2,445,045 | 7/1948 | Strachen | 181/280 |
| 3,927,731 | 12/1975 | Lancaster | 181/274 X |
| 3,948,349 | 4/1976 | Bychinsky | 181/206 |
| 4,299,253 | 11/1981 | Burton | 181/206 X |

FOREIGN PATENT DOCUMENTS

| | | | |
|---|---|---|---|
| 746798 | 6/1933 | France | 181/280 |
| 2227808 | 11/1974 | France | 181/279 |

*Primary Examiner*—Benjamin R. Fuller

*Attorney, Agent, or Firm*—Lowe Price Leblanc Becker & Shur

[57] ABSTRACT

The silencer device set forth herein in its various embodiments consists of at least one channelling bounded by at least one turn of a flat spiral, or of a cylindrical helix, or of a tapered helix, which may be blanked-off or open at one of its ends or at both of its ends, and/or incorporate radial holes or frontal holes in one or both faces. The outermost turn of the spiral, or the outermost surface of the helix, may either provide the shell of the device, or form a part thereof.

14 Claims, 20 Drawing Figures

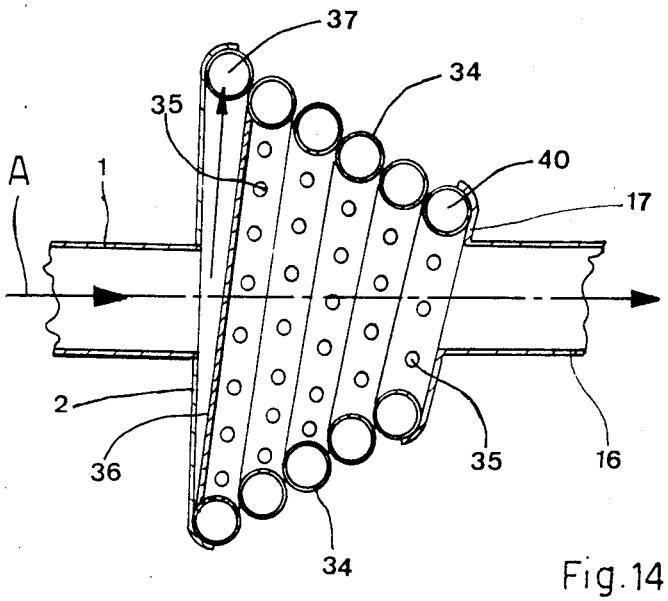
Fig. 14
Fig. 15
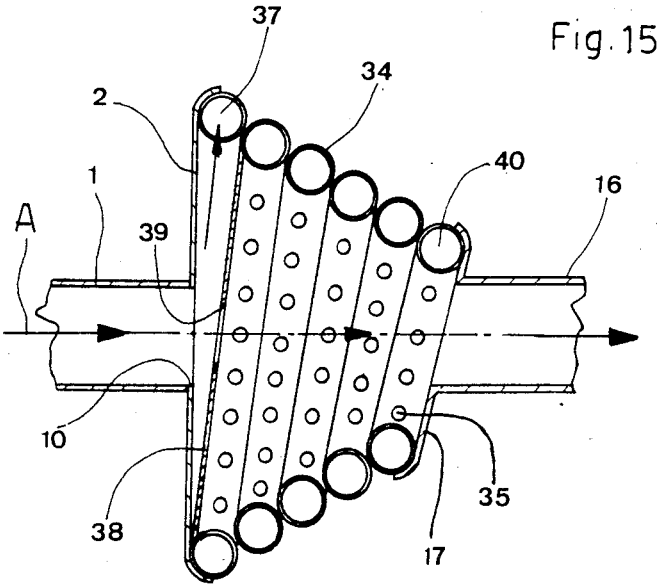

EXHAUST GAS SILENCER

The present invention relates to a silencer device for exhaust gases in particular, and for dampening the noise effect of fast-moving gases generally, by incorporation as a component in an exhaust system which exhausts post-combustion gases from an internal combustion engine, or for use within inlet lines or compression lines where gas is caused to travel at a high velocity.

The prior art discloses silencers consisting of an enclosure or box-member furnished with an inlet and an outlet for exhaust gases, such as a motor vehicle exhaust-pipe silencer. Such silencers serve to reduce noise levels, and work on the following scientific principles: via friction losses, with the gas being induced to flow through a porous medium; via sound-wave absorption, with gas flow impeded and broken up by being directed through passages of varying length, or bounced through a series of baffles; via sound-wave deflection with the gas passing through a pipe incorporating a series of restricted and enlarged sections; or via an injection system whereby a practically continuous drip of fluid introduced into the gas causes its cooling by evaporation. Types of silencers include those with sound-absorbing filters arranged either in series, in parallel, or other combinations; those having a succession of chambers interconnected by holes or short pipes; those operating as a manifold where gas is directed through a perforated sprial tube; and those of a composite construction where the gas is channelled partly through a central pipe, and partly through a helical structure coaxially wound around the central pipe. In various silencers a sound-absorbing material is located in flow passages imposing directional changes on the gas, which may line either the entire enclosure, or a part thereof.

The effective silencing action produced by these known types of silencer would appear insufficient on the basis of permissible exhaust back-pressure and of the dimensions of the silencer itself which, in a great many instances, does not in fact consist of one enclosure only, but requires two or more such units ranged along the length of the exhaust pipe.

The state of the art thus outlined leaves room for improvement, inasmuch as the requirement exists for better silencing, and better methods of bringing about such silencing, whereby the need for sound-absorbent materials can be dispensed with wholly or in part-these materials being inclined to change state and disintegrate-and other drawbacks eliminated.

From the foregoing, there exists a need for producing an enhanced silencing action compared to that produced by the prior art, while ensuring low exhaust back-pressure at the outlet of the silencer, reduction in the overall dimension of the silencer, and dispensing with—or at least, reducing—the requirement for sound-absorbent material.

The invention resolves the foregoing technical problem with a silencer wherein gases are directed generally through a channelling bounded by at least one turn of a flat spiral, a cylindrical helix, or a tapered helix. The channelling is either blocked off or open at one end, blocked off or open at both ends, and may incorporate frontal or radial holes in one or both faces. The outermost turn of the spiral or the outermost surface of said helix may provide the shell of said device or form a part thereof. The pitch of the flat spiral or of said cylindrical or tapered helical channelling is selected to maintain back-pressure within prescribed limits, and the number of turns in the spiral/helical channelling is matched to the flow-characteristics and frequency of gas and sound-waves-viz, lower frequencies, more turns.

Advantages achieved with the invention are: highly-effective damping of noise-levels; low exhaust back-pressure and as a result, enhanced performance; efficient noise reduction over a wide range of frequency bands, giving the possibility of numerous types of application; no resonance chambers; elimination of rumble; expulsion of condensed water and impurities along with the gas, by virtue of there being no labyrinth; constructional simplicity, and finally, reduced weight and dimensions.

A number of embodiments of the invention will now be described with the aid of the accompanying drawings, in which:

FIG. 14 is the longitudinal section through a silencer embodied as a tapered tubular helix, wherein gas enters at one end of the tubular element and exits both from the remaining end and from the central area encircled by the self-same helix;

FIG. 15 is the section through a tapered-helix type of embodiment as in FIG. 14, wherein gas enters both the tubular element and the central area encircled by the helix;

Figure 1:
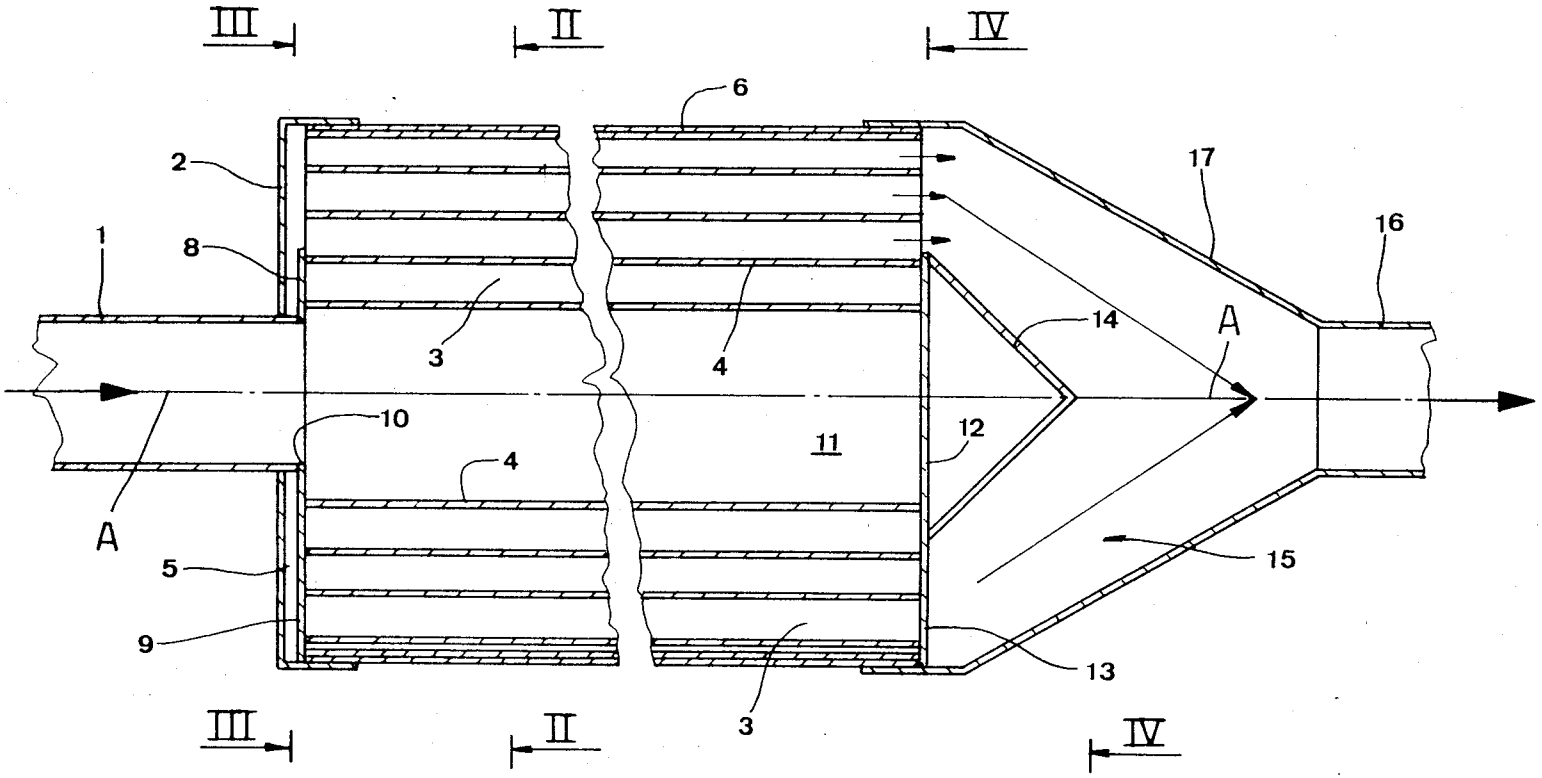
FIG. 1 is a longitudinal section through one spiral-type silencer of the invention, wherein gases are channelled through a flat spiral whose exhaust gas inlet is centrally located at one end, while the outlet is peripherally located at the other.
Figure 2:
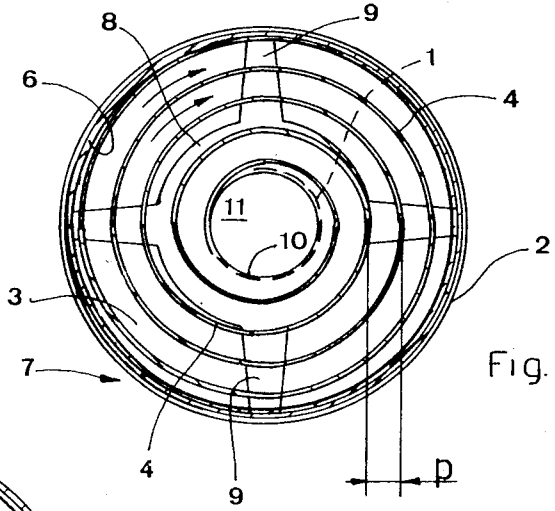
FIG. 2 is the section through II—II in FIG. 1, and illustrates the pitch p of the flat spiral.
Figure 3:
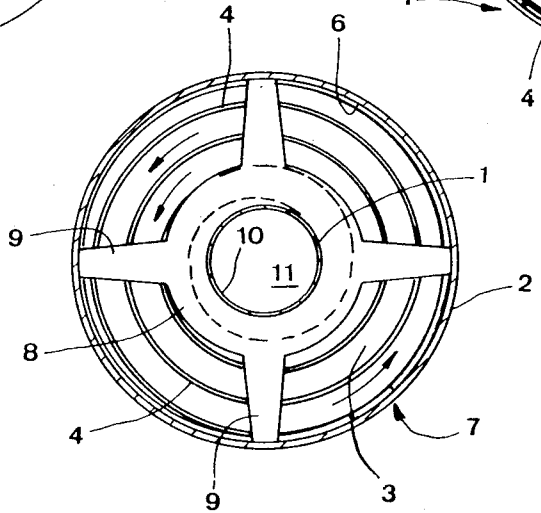
FIG. 3 is the section through III—III in FIG. 1.
Figure 4:
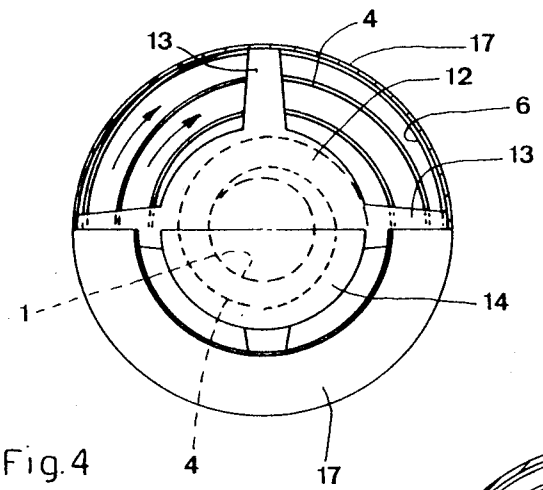
FIG. 4 is the section through IV—IV in FIG. 1.
Figure 9:
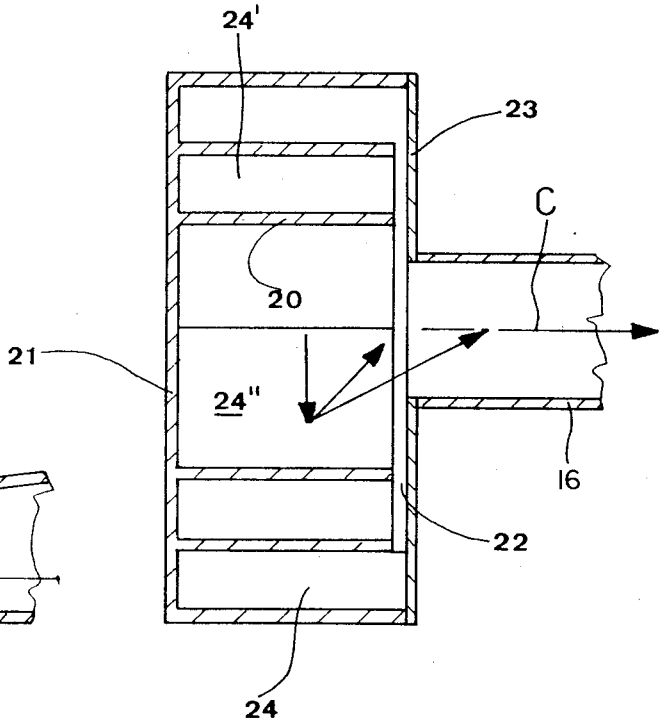
FIG. 9 is the longitudinal axial section through IX—IX in FIG. 8.
Figure 8:
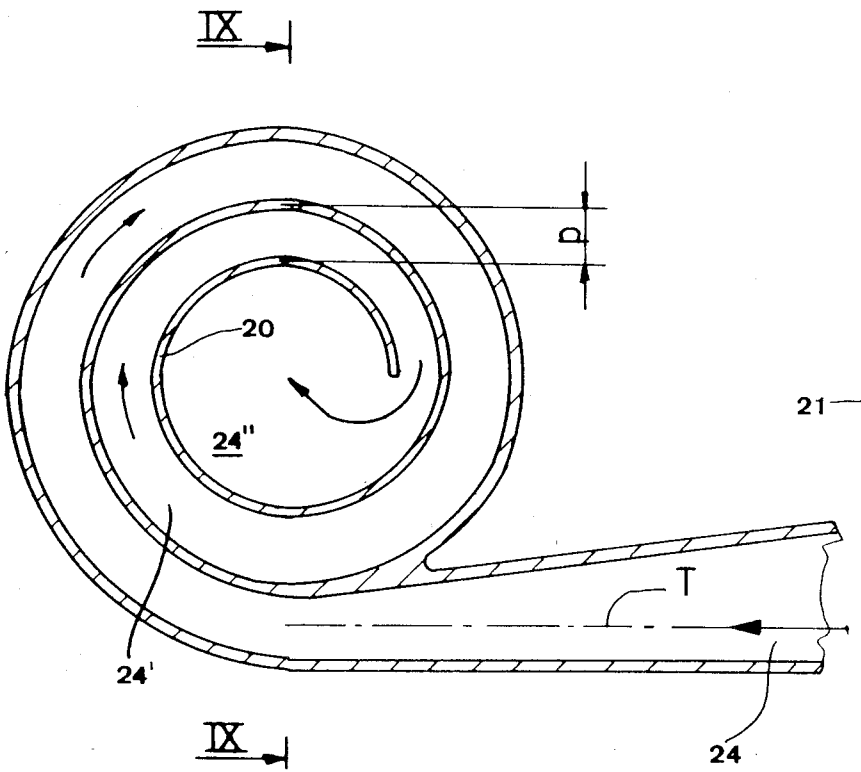
FIG. 8 is the cross section through a silencer embodied as a flat spiral, wherein the flow of gas enters at a tangent and exits axially.
Figure 11:
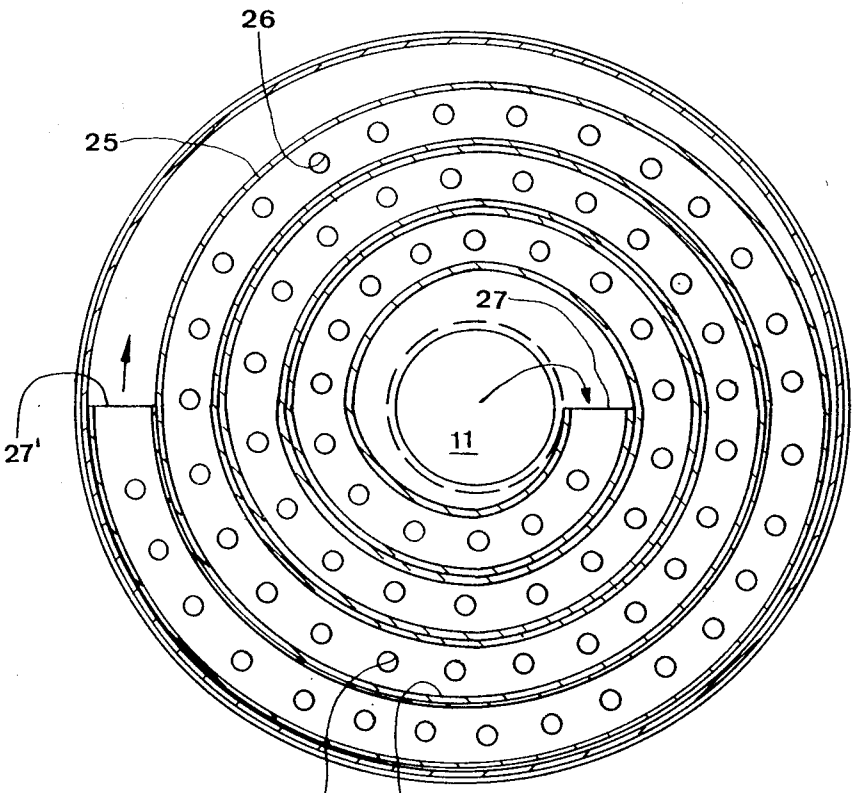
FIG. 11 is the section through XI—XI in FIG. 10.

With reference to the drawings, 1 denotes the pipe carrying gases into the silencer, and A its longitudinal axis. 2 is a front cover located at the inlet side where gases enter the silencer. 3 denotes a channelling arrangement embodied as a spiral wound from sheet metal; and 4 denotes the single turns of the spiral. The spaced 5 defines a front sound-wave interference chamber that may be filled with sound-absorbent or sound-reflecting material. 6 denotes the outermost turn of the spiral, which is cylindrical, since its two ends are welded together at 7 to form the outer shell of the silencer (see FIG. 2). 8 denotes a capping-ring closing off the ends of the innermost turns of the spiral at the inlet-end of the silencer. The ring 8 is furnished with radially-disposed ribs 9 which are welded to the ends of the remaining outer turns 4 to maintain correct spacing. The hole 10 defined by capping-ring 8 serves to connect inlet pipe 1 with a central chamber 11 extending along longitudinal axis A through the center of spiral channelling 3. The chamber 11 is closed off at the end opposite hole 10 by a disc baffle 12 furnished with radial ribs 13 identical to ribs 9. The ribs 13 project radially from the capping-ring. 14 denotes a conical extension which may be fitted to baffle 12 for improving gas-flow out of the spiral 3 and into a rear chamber 15 which exhausts axially into a tail pipe 16 having the same axis A as aforementioned. 17 denotes a conical frustum extending from the outermost turn 6 of said spiral channelling, which serves a purely aerodynamic purpose and encloses said chamber 15, this in its turn serving to bring about an interference effect. The chamber denoted 18 (see FIG. 5) is likewise both an exhaust and an interference chamber, and is enclosed within a peripheral protrusion of the spiral channelling's final outermost turn 6. Said chamber 18 exhibits a cross-section of crescent shape, and tapers away toward the front end of the silencer. The exhaust tailpipe 16 in this instance departs from the downstream central area of said chamber 18, its axis B offset with respect to said axis A. 19 denotes a rear cover which encloses the silencer-end and at the same time creates a further rear interference chamber 19′ which causes the rear ends of turns in the spiral channelling 3 to intercommunicate, and can be filled with sound-absorbent material. The flat spiral denoted 20 (see FIGS. 8 and 9) has one end fastened to a base 21, while the remaining end leads into an interference-and-exhaust chamber 22 whose peripheral area is enclosed by a capping-ring 23, at the centre of which is tail-pipe 16. In this embodiment, the inlet and outlet axes T and C, respectively, are arranged skew, 24 denoting the T-oriented inlet pipe through which gas passes so tangentially to enter the spiral channelling 24′ passing into the central chamber 24″ which communicates with chamber 22. 25 denotes a flat spiral (see FIGS. 10 and 11) in which the channelling consists of a tubular element wound tight within a plane transverse to the longitudinal axis A of inlet-pipe 1 and tail-pipe 16, and provided with radial holes 26 in either face. Considering the curvilinear longitudinal path through the tubular element travelled by gases, the holes 26 perform the role of front and rear orifices. The initial winding of the tubular element away from the center of the element can have no such orifices since it is masked by ring 8 at the front, and baffle 12 at the rear. Gases are directed into the element via the end 27 nearest the center of the spiral; the farthest end 27′ of the element may either open or closed.

A further variation of the same embodiment envisages an inlet chamber 28 (FIGS. 12 and 13) opening into the entire spiral, the spiral in this instance being in the form of a tubular element 29 similar to element 25 in all respects save that only rear orifices 30 are incorporated, and that gas enters via both ends 31 and 32 of the spiral. 33 denotes a central hole which may be formed in rear baffle 12 to provide a straight-through passage from inlet chamber 28 to rear chamber 15.

The embodiment shown in FIGS. 14 and 15 has a channelling arrangement which takes the form of a helix 34 formed from a tubular element and tapering from front to rear along longitudinal axis A. The turns of the helix are tightly wound, and exhibit radial holes 35 through which exhaust gases are directed from inlet pipe 1. 36 denotes a front baffle (see FIG. 14) downstream from which a conical exhaust and interference chamber, encircled by the tapered helix and thus tapered in its turn, receives exhaust gases from the helix through holes 35. Gases enter the tubular element via end 37 at the periphery of the silencer created by the first turn of the helix. 38 denotes a baffle (see FIG. 15) in which a central hole 39 is formed to allow a straight-through passage of gases not channelled through the end 37 of the tubular element, whose remaining end 40 can either be left open or closed off.

Figure 16:
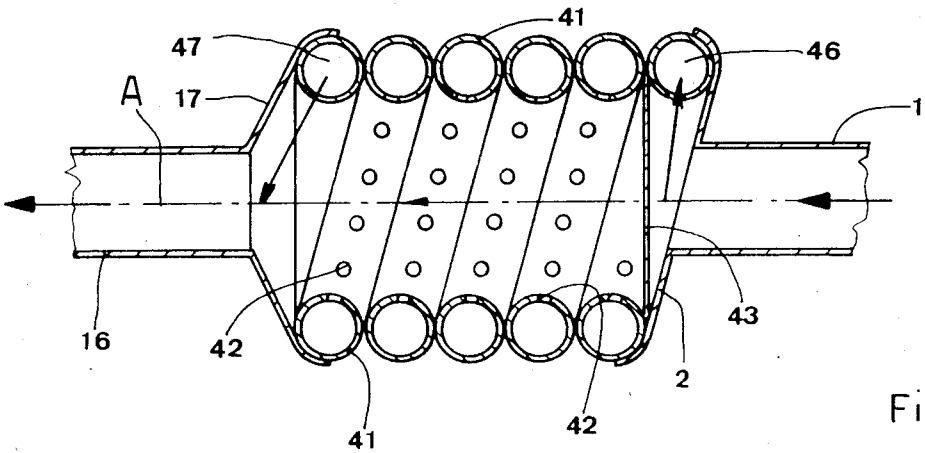
FIG. 16 is the longitudinal section through a silencer embodied as a cylindrical tubular helix, wherein gas enters at one end of the tubular element and exits both from the remaining end and from the central area encircled by the self-same helix.
Figure 17:
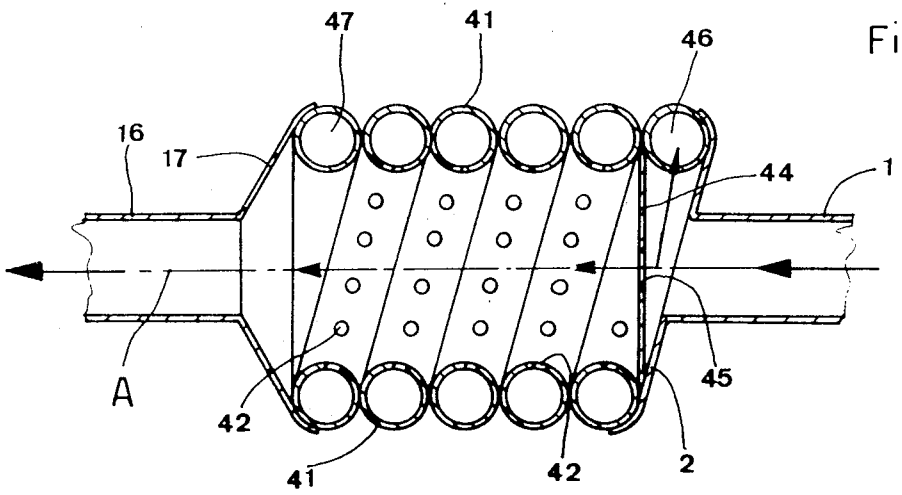
FIG. 17 is the section through a cylindrical-helix type of embodiment as in FIG. 16, wherein gas enters both the tubular element and the central area encircled by the helix.

A further embodiment (see FIGS. 16 and 17) envisages a tubular element 40 wound tightly into a cylindrical helix and provided with internal radial holes 42 which exhaust gas toward longitudinal axis A—the latter being common to both inlet and tail pipes 1 and 16. 43 denotes a front disc-baffle (see FIG. 16) which closes off the upstream end of the cylindrical chamber formed between coils of the helix, said chamber communicating with the tail pipe 16. Alternatively, a baffle 44 replacing 43 can be provided with a central hole 45 (see FIG. 17) to allow part of the gas to exhaust straight through into the chamber and out through tail pipe 16, while the remainder enters the tubular element via end 46 and follows its helical course. The remaining end of the helix is denoted 47, and can either be left open or closed in both versions of this particular embodiment.

48 and 49 (see FIG. 18) denote inlet pipes connected with a helical tubular element formed cylindrically as element 41 described above, and similarly disposed about longitudinal axis A. The front end of this particular embodiment is closed off completely by an end-wall 50. The pipe denoted 48 connects with the foremost end of the tubular helix, while pipe 49 connects with the remaining end thereof. Radial holes 42 in the tubular element open into the cylindrical chamber created by the tubular element, where gases are directed out through a conical frustum 17 and into the tail pipe 16.

A silencer according to the invention would operate as follows. With reference to FIGS. 1 to 4, gases moving at high speed due to turbulence and other physical phenomena, and as such carriers of sound waves of an intolerable intensity, enter the central chamber 11 of spiral channelling 3, in this case created by wound sheet metal 4. From the chamber, the gases follow the course of the spiral and exit into the silencer's rear chamber 15 via the open ends of the outer turns of the spiralled metal sheet. In this manner, sound waves entering said rear chamber 15 are subjected to an interference effect through their being phased across a wide range of frequencies—this by virtue of the imposed spiral path—and the intensity aforesaid is thus dampened. Further contributory factors to this dampening effect include the phase shift produced at individual radial sections in the channelling 3 by virtue of the high degree of laminar flow imparted to the gas by spiralling, and of the fact that pressure peaks are cut off by the considerable centrifugal force set up by such spiral flow; also, the vibrations produced at all points of the sheet metal spiral 4, on either side, are transmitted radially—out of phase and at varying frequency—thus becoming subject to interference and dampening so as to avoid generating noise in the structure of the silencer as a whole, and at the same time, reduce the noise energy-level. The overall result obtained is that of reducing the intensity of exhaust noise well below regulation limits, while keeping back-pressure down and ensuring compact dimensions.

Figure 5:
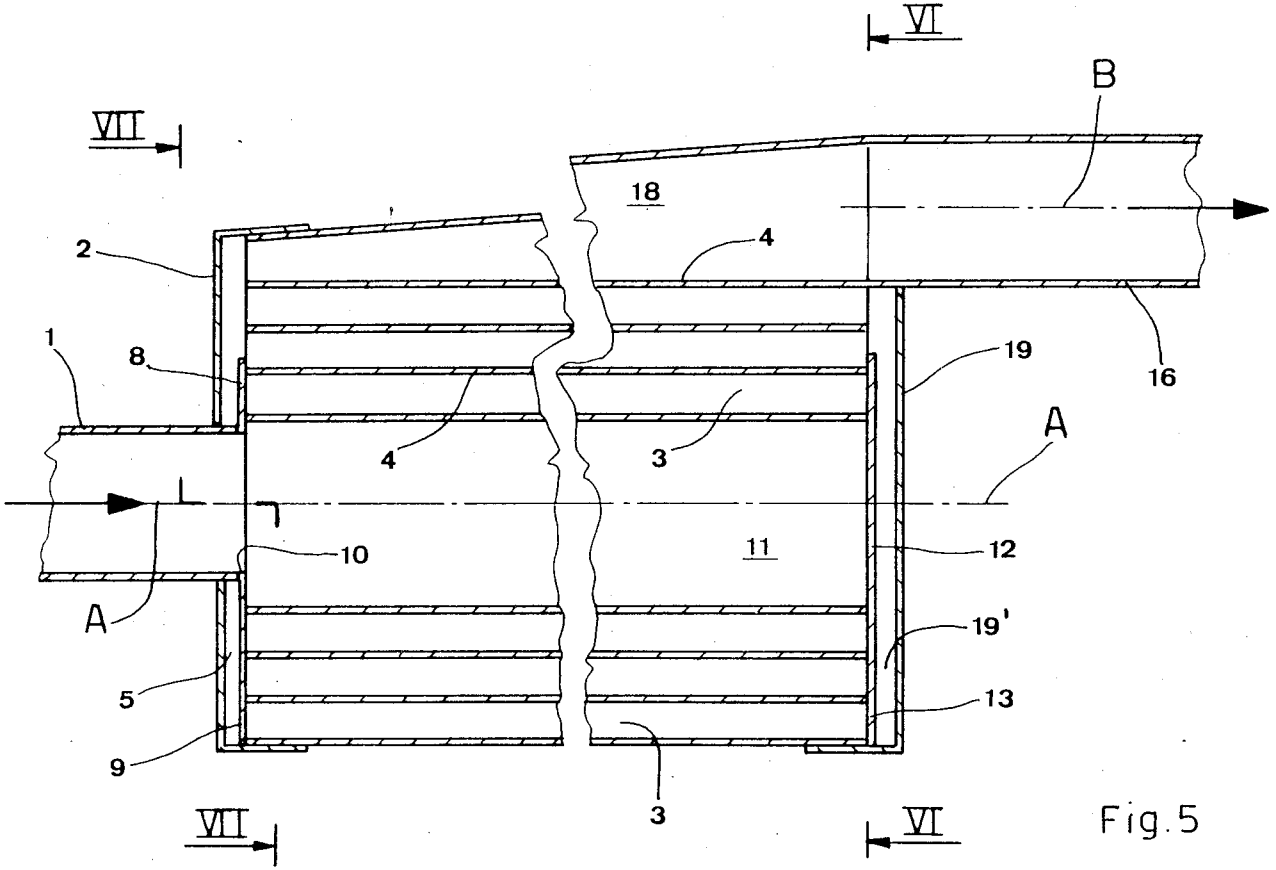
FIG. 5 is the longitudinal section through a silencer similar to that in FIG. 1, though with an outlet issuing direct from the final turn of the flat spiral.
Figure 6:
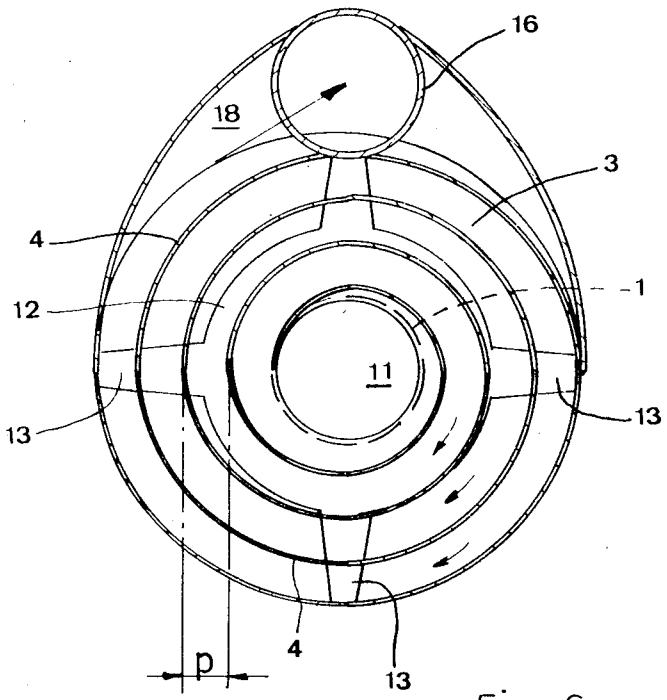
FIG. 6 is the section through VI—VI in FIG. 5.
Figure 7:
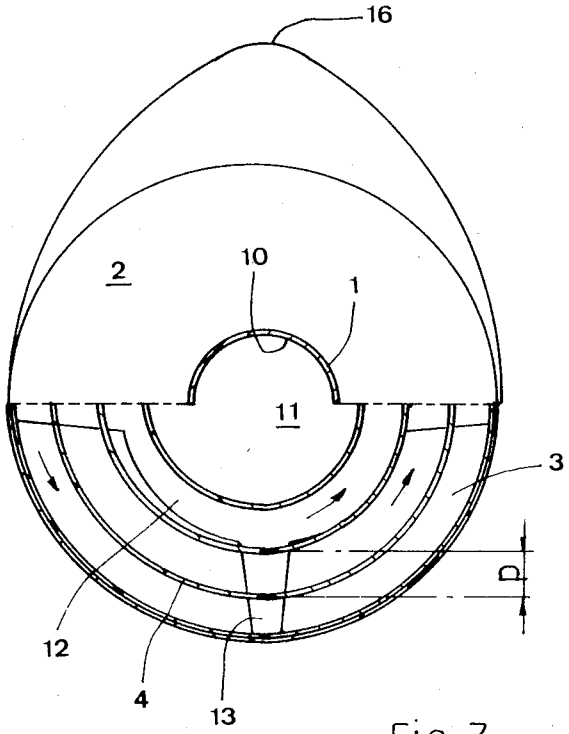
FIG. 7 is the section through VII—VII in FIG. 5.
Figure 10:
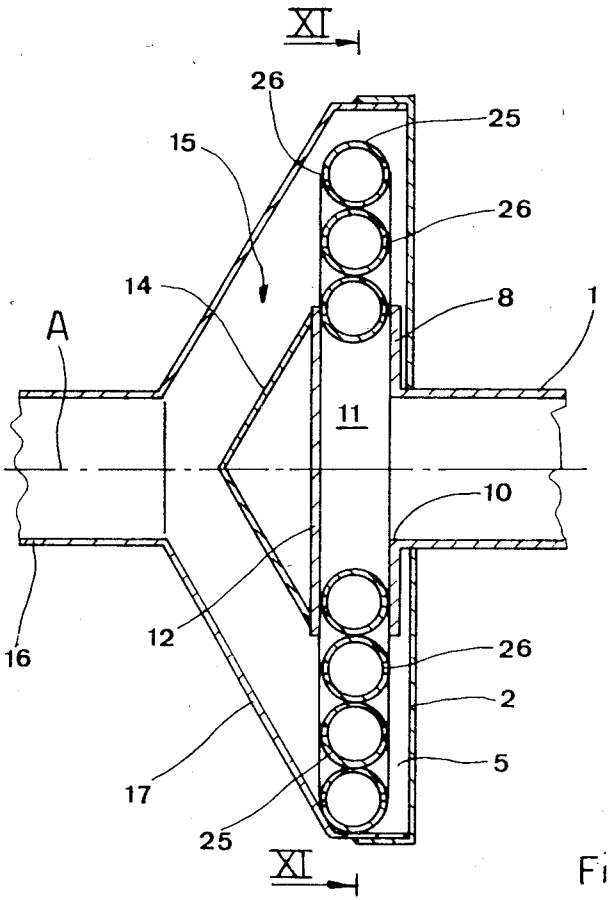
FIG. 10 is the longitudinal section through a silencer embodied as a flat tubular spiral, wherein gas is caused to enter at the centre, and exit at the periphery.
Figure 13:
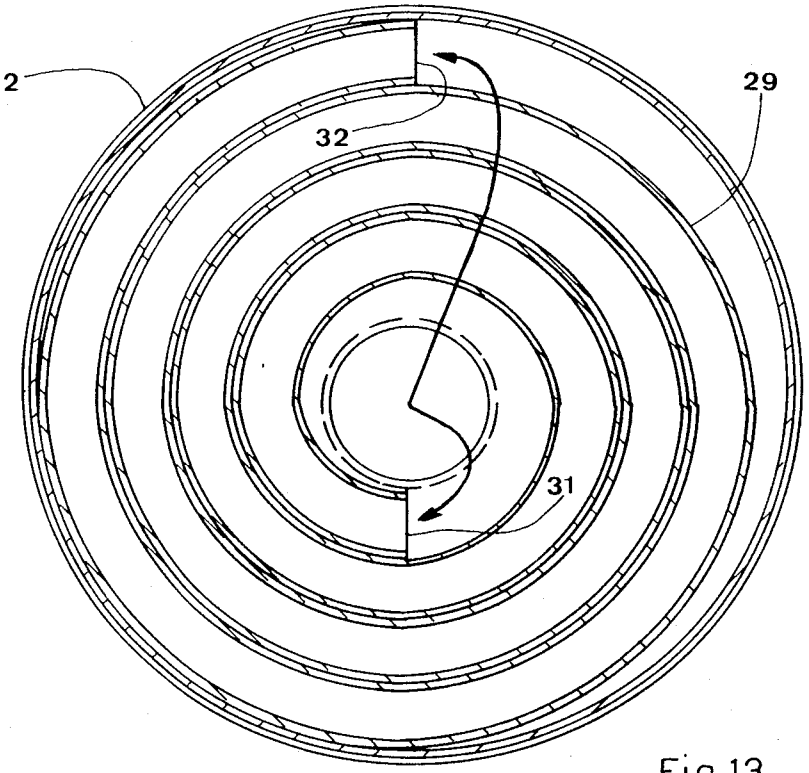
FIG. 13 is the section through XIII—XIII in FIG. 12.
Figure 12:
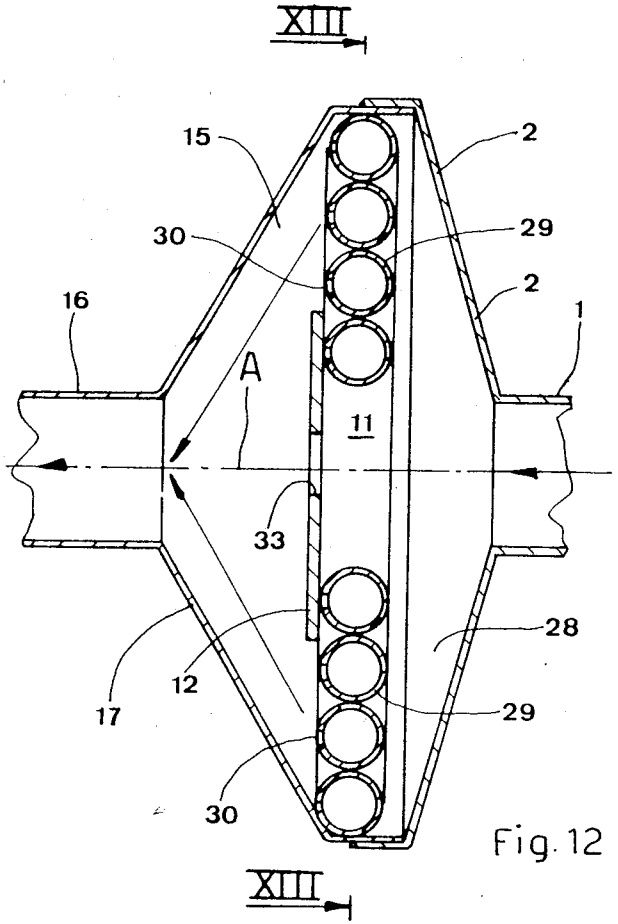
FIG. 12 is the longitudinal section through a silencer similar to that in FIG. 10, though with gas entering the spiral at the end of its tubular element.
Figure 18:
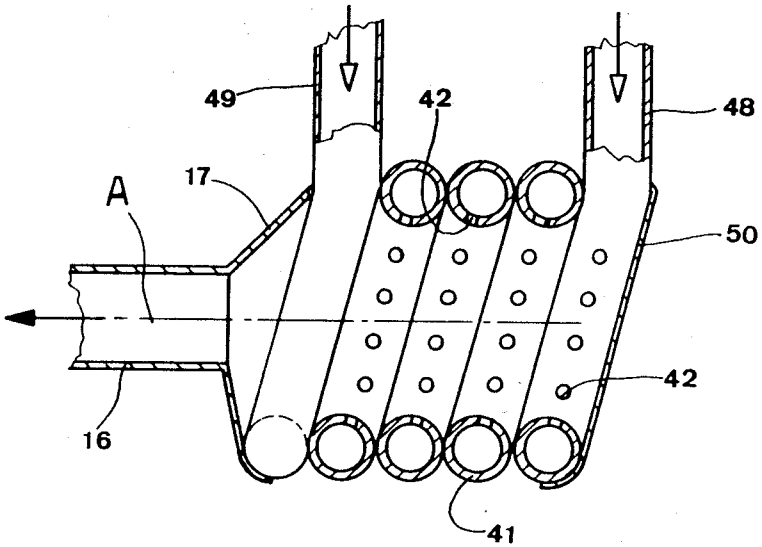
FIG. 18 is the longitudinal section through a cylindrical helix type of embodiment as in FIG. 16, wherein gas enters via the two ends of the tubular element and exits from one end of the cylindrical central area encircled by the helix.
Figure 19:
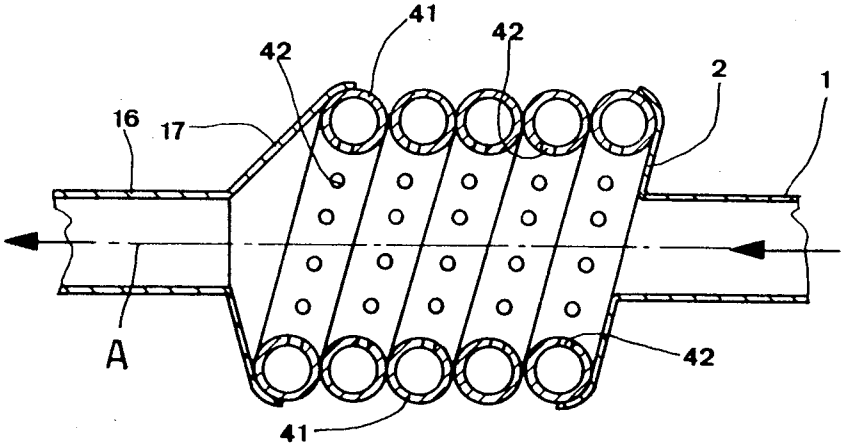
FIG. 19 is the longitudinal section through a silencer as in FIG. 16, wherein gas enters and exits solely via the cylindrical central area encircled by the tubular element forming said cylindrical and tubular helix.
Figure 20:
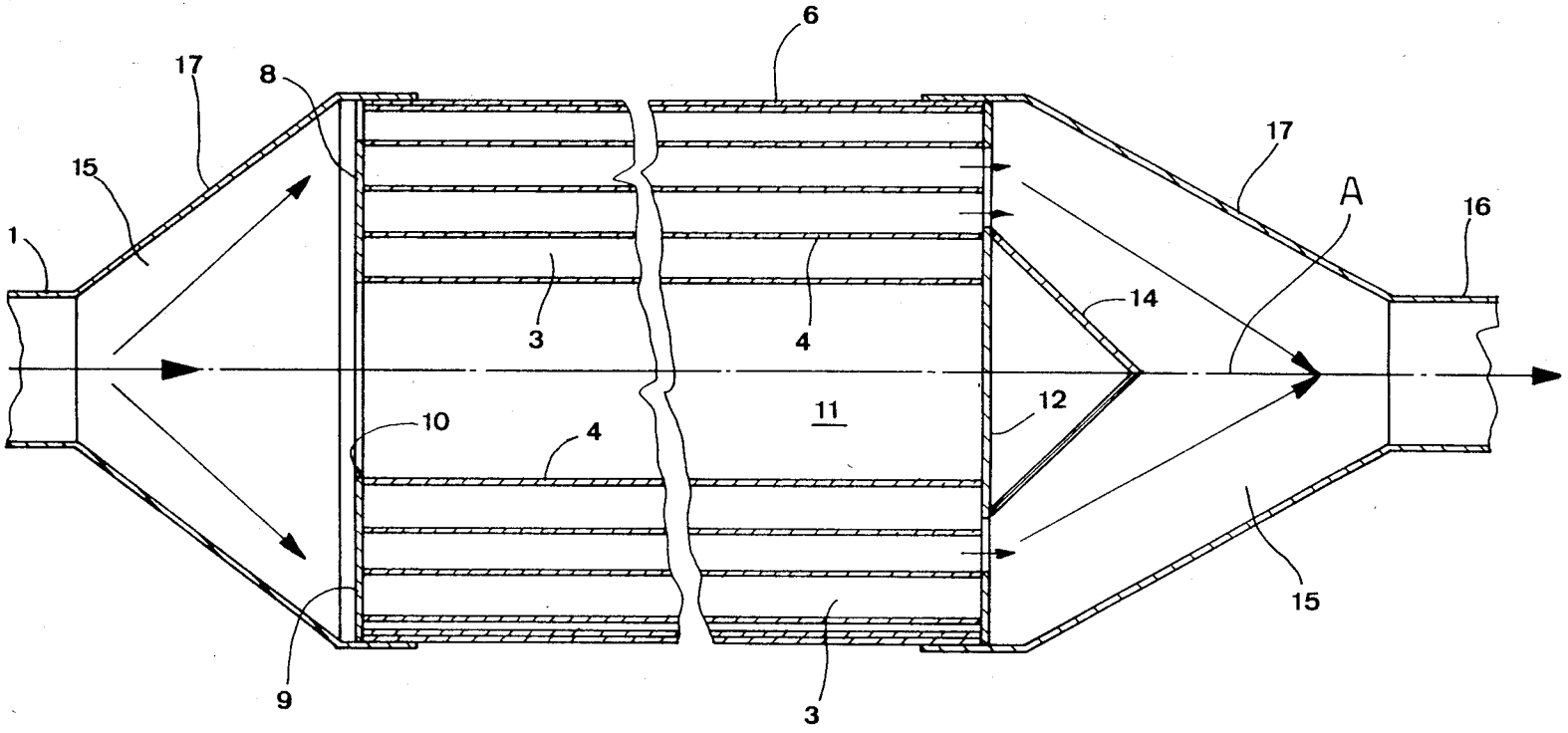
FIG. 20 is a longitudinal section of a silencer like that of FIG. 1, which incorporates two conical frusta, one of which serving as an expansion medium, particularly in two-stroke applications.

In the embodiment illustrated in FIGS. 5, 6 and 7, the offset exhaust chamber 18 contributes further to reduction of the noise-level. In the case of the embodiment in FIGS. 8 and 9, the tranversely-disposed rear chamber 22 contributes to noise-reduction by creating interference. In FIG. 10, interference set up in the silencer's rear chamber 15 is due mainly to the way that gas is caused to exit from holes 26 located in the rear face of the flat tubular spiral 25, though there is additional flow from holes 26 located in the front face of the spiral, since front and rear chambers 5 and 15 communicate at the peripheral area of the tubular element. In FIGS. 12 and 13, interference comes about in the rear chamber 15 only, since holes 30 are provided only in the rear face of the tubular spiral 29. The option of a central hole 33 in rear baffle 12 meets the requirement for a partial straight-through flow aimed at reducing back-pressure, and will thus be of appropriate size for the desired effect. Further, entry of the gas via both ends 31 and 32 of the flat tubular spiral contributes to the reduction of back-pressure, since flow area into the tube is doubled. With the tubular helix type of embodiment shown in FIGS. 14 and 15, interference is set up within the conical chamber created at the centre of the tapering, tightly-wound tubular channelling 34. This chamber becomes the main interference and exhaust passage, and in the event that the rear end 40 of the tubular helix should be blanked off, gas will flow thereinto solely via radial holes 35 in the tube which converge onto axis A. As with the flat tubular spiral embodiment, one has the option of reducing back-pressure further by means of a central hole 39 in the front baffle 38. The same principles apply for the cylindrical tubular helix embodiment illustrated in FIGS. 16 and 17. In FIG. 18, one has entry of gases via both ends of the cylindrical tubular helix 48 and 49 and 41 respectively, this so as to cut down the level of back-pressure. In FIG. 19, the straight-through type of embodiment permits gas to flow freely through what is in this case simply a transit chamber, whilst transmitting sound-waves through radial holes 42 into the tubular element 41, thereby bringing about interference and reducing noise-levels. When carrying the invention into effect, the materials employed, the design, and the constructional details, and in particular, the embodiment of the flat spiral or helical element, may all differ from those thus far illustrated whilst remaining equivalent in terms of the art: for instance, the various embodiments can be inverted with respect to the direction of gas flow, and the spirals themselves can be created by moulding techniques, by welding sheet metal, or by any other suitable technology currently available. The actual number of turns in the single spiral can vary according to the individual requirement—as indeed the pitch p can be varied, though a constant pitch is preferable. Further, the silencer element, whether a flat spiral or a tapered/cylindrical helix, whether exhibiting an outwardly-or-inwardly tapering, or flattened profile, can be housed either in a ready-made shell or in a purpose-built enclosure—the latter option perhaps favouring aerodynamic requirements or simply those of good looks. The sectional area of tubular elements according to the invention could be varied from point to point, though a constant diameter/width would favour production in economical terms. Again, the embodiment illustrated in FIG. 1 could incorporate two front and rear chambers 15 bounded by respective conical frusta 17 (see FIG. 20), one of which serving as an expansion medium—particularly in two-stroke applications; in this instance, the capping ring 8 would be such as to leave only the peripheral turns 4 of the spiral open at the front end, whilst a ring 51 at the rear end would blank off the peripheral part of the spiral. Lastly, the profile exhibited by tubular channelling, whether flat spiral or helical, is illustrated as circular for ease of manufacture. Nonetheless, the shape may equally well be square, rectangular, oval or whatever. The sectional area of the channelling and the degree of offset may be determined at the design stage, and the alignment or otherwise of inlet and tail pipes would be decided upon according to whether the application calls for a deliberately-contrived acoustic effect, or for maximum noise-reduction.

I claim:

1. Silencer device for exhaust and high velocity gases, comprising an enclosure provided with an inlet pipe and a tail pipe, and means defining at least one channel within the enclosure having a curvilinear axis along which gases are directed from said inlet pipe, said enclosure further including at least one sound-wave interference chamber in communication with and formed by side wall means connected to extend between said channel and said tail pipe; said channel being open at both ends thereof and being defined by a sheet of metal rolled into a spiral; an outermost turn of said spiral being cylindrical and secured to an adjacent inner turn of the spiral to form the shell of the device; a capping ring provided with radially-extending support ribs and a central hole, said ring being fixed to the ends of innermost turns of the spiral at the inlet end thereof; a central chamber formed with the center of said spiral in communication with said channel and with the inlet pipe through said central hole; an opposite end of said chamber being closed by a disc baffle having radial support arms; a front cover fitted to the outermost turn of the spiral at said inlet end to establish a front sound-wave interference chamber between the cover and the spiral channel.

2. Silencer as in claim 1, wherein said side wall means includes a conical frustum structure attached to said outermost turn of said spiral channel at the end thereof opposite said inlet end, said frustum establishing a rear chamber being said sound-wave interference chamber through which gas exhaust flows from said channel to create sound-wave interference; and a conical extension fitted to said baffle for improving gas-flow from said channel into said rear chamber and into the tail pipe, said conical extension having an axis aligned with that of the inlet pipe.

3. Silencer as in claim 2, further including a front end chamber in communication with the front end of the spiral, the front chamber providing for expansion of gases; said front chamber defined by a conical frusta; and a capping ring fixed to innermost turns of the flat spiral at the inlet end thereof.

4. Silencer as in claim 1, wherein said sound-wave interference chamber is enclosed within a peripheral protrusion formed within an outermost turn of the spiral channel, and having a crescent shaped cross-section tapering in the direction of the inlet end of the silencer; said tail pipe having an axis off-set with respect to the axis of the inlet pipe, said silencer further comprising a rear cover fixed to an end of said spiral channel opposite said inlet end to form a rear interference chamber causing rear ends of turns in the spiral channel to intercommunicate.

5. Silencer device for exhaust and high velocity gases, comprising an enclosure provided with an inlet pipe and a tail pipe, and means defining at least one channel within the enclosure having a curvilinear axis through which gases are directed from said inlet pipe, said enclosure further including at least one sound-wave interference chamber in communication with and formed by side wall means connected to extend between said channel and said tail pipe; said channel being formed by a flat spiral member having a series of turns fastened to a base at one end thereof, and open at the remaining end for communication with said sound-wave interference chamber having a peripheral area enclosed by a capping ring connected to said tail pipe; a central chamber being formed within the spiral by an innermost turn thereof, said central chamber communicating with said tail pipe through said chamber; said inlet pipe being connected tangentially to an outermost turn of the spiral so that the inlet axis is skewed with respect to the axis of said tail pipe.

6. Silencer device for exhaust and high velocity gases, comprising an enclosure provided with an inlet pipe and a tail pipe, and means defining at least one channel having a curvilinear axis through which gases are directed, said channel communicating with said inlet pipe and with at least one sound-wave interference chamber formed by side wall means connected to extend between said channel and tail pipe and communicating with said tail pipe; said channel being formed from a tubular element wound tightly into a flat spiral and disposed within a plane transverse to the axis of said inlet pipe and said tail pipe.

7. Silencer as in claim 6, wherein said tubular element includes radial holes located at either side thereof with respect to said transverse plane to function as front and rear orifices, through which gases exhaust; said radial holes communicating with a front interference chamber formed between a front face of the spiral and a front cover, and with said sound-wave interference chamber being a rear interference and exhaust chamber formed by a conical frustum; said front and rear interference chambers communicating with each other and with said inlet and tail pipes; a capping ring fixed to the innermost turns of said tubular element and being provided with a central hole to permit communication between said inlet pipe and a central chamber of the spiral in communication with an open end of said tubular channel formed thereby; said central chamber being closed off at the side opposite said inlet pipe by a disc baffle fitted with a conical extension, said extension improving gas flow through said chamber; whereby gases directed into said channel from the inlet pipe are exhausted from at least one of said radial holes and from both the radial holes and an open discharge end of said channel.

8. Silencer as in claim 6, wherein said tubular element is provided with rear radial holes only, and further including an inlet chamber formed within a front cover connected to the inlet pipe, said inlet chamber communicating with an entire face of the spiral facing the inlet side of the silencer; and a disc baffle secured to innermost turns of the spiral and having a central hole providing straight-line communication between the inlet chamber and the rear exhaust interference chamber; gas thereby being directed into at least one of the open ends of the spiral tubular element.

9. Silencer device for exhaust and high velocity gases, comprising an enclosure provided with an inlet pipe and a tail pipe, and means defining at least one channel having a curvilinear axis and through which gases are directed, said channel communicating with said inlet pipe and with at least one conical sound-wave exhaust and interference chamber communicating with said tail pipe; said channel being formed from a tubular element containing windings wound tightly into a tapering helix and provided with radial holes through which gases exhaust into the tail pipe; a front baffle closing off the conical exhaust and interference chamber formed by and between windings of said tapering helix; said helical channel receiving gases from the inlet pipe through an open end of an initial turn of said tubular element.

10. Silencer as in claim 9, wherein said front disc baffle is provided with a central hole to allow for straight-through flow of part of the exhaust gases from said inlet pipe to said tail pipe through said conical chamber.

11. Silencer device for exhaust and high velocity gases, comprising an enclosure provided with an inlet pipe and a tail pipe, and means defining at least one channel having a curvilinear axis and through which gases are directed, said channel communicating with said inlet pipe and with at least one sound-wave interference chamber communicating with said tail pipe; said channel being formed from a tubular element containing windings wound tightly into a cylindrical helix and provided with radial holes, said sound-wave interference chamber being formed between and by windings of said cylindrical helix.

12. Silencer as in claim 11, further including a front disc baffle closing off the sound-wave interference chamber created by said cylindrical helix so that the helical channel receives gases from the inlet pipe through an open end of an initial turn of said tubular element.

13. Silencer as in claim 12, wherein said front disc baffle is provided with a central hole to allow for straight-through flow of part of the exhaust gases from said inlet pipe to said tail pipe through said interference chamber.

14. Silencer as in claim 11, further including a pair of inlet pipes respectively connected with the open end of the initial turn of said tubular element and with the remaining open end of said element, said radial holes communicating with the sound-wave interference chamber formed within the helix which communicates with the tail pipe; a front end of the silencer being closed off by an endwall.

* * * * *

UNITED STATES PATENT AND TRADEMARK OFFICE

CERTIFICATE OF CORRECTION

PATENT NO. : 4,579,195

DATED : April 1, 1986

INVENTOR(S) : Giuseppe NIERI

It is certified that error appears in the above-identified patent and that said Letters Patent is hereby corrected as shown below:

On the title page item /76/ should read

-- [76] Inventor: Giuseppe Nieri, 30 Piazza Gramsci, 57023 Cecina (Livorno), Italy --.

Signed and Sealed this

*Twenty-second* Day of *July 1986*

[SEAL]

*Attest:*

DONALD J. QUIGG

*Attesting Officer*

*Commissioner of Patents and Trademarks*